US007073737B2

(12) United States Patent
Schulte et al.

(10) Patent No.: US 7,073,737 B2
(45) Date of Patent: Jul. 11, 2006

(54) TUBE GRINDER AND METHOD FOR COMMINUTING LUMPY GRINDING STOCK

(75) Inventors: Ludger Schulte, Ahlen (DE); Frank Ungethüm, Beckum (DE); Robert Schnatz, Hamm (DE); Thomas Rüther, Drensteinfurt (DE); Ludwig Könning, Ahlen (DE); Jens Reimers, Hamm (DE); Hubert Eickholt, Beckum (DE); Dirk Dilly, Beckum (DE); Heinz Alker, Ahlen (DE); Reinhard Giesemann, Harsewinkel (DE)

(73) Assignee: Polysius AG, Beckum (DE)

( * ) Notice: Subject to any disclaimer, the term of this patent is extended or adjusted under 35 U.S.C. 154(b) by 0 days.

(21) Appl. No.: 10/497,293

(22) PCT Filed: Nov. 28, 2002

(86) PCT No.: PCT/EP02/13461

§ 371 (c)(1),
(2), (4) Date: Oct. 5, 2004

(87) PCT Pub. No.: WO03/045563

PCT Pub. Date: Jun. 5, 2003

(65) Prior Publication Data

US 2005/0029374 A1 Feb. 10, 2005

(30) Foreign Application Priority Data

Nov. 29, 2001 (DE) ..... 101 58 710

(51) Int. Cl.
*B02C 17/06* (2006.01)

(52) U.S. Cl. ..... 241/30; 241/72; 241/80; 241/97

(58) Field of Classification Search ..... 241/72, 241/97, 80, 30, 299, 176, 177, 178
See application file for complete search history.

(56) References Cited

U.S. PATENT DOCUMENTS

| | | | | |
|---|---|---|---|---|
| 1,504,777 | A * | 8/1924 | Newhouse | 241/78 |
| 1,748,920 | A * | 2/1930 | Newhouse | 241/19 |
| 4,369,926 | A * | 1/1983 | Rasmussen et al. | 241/18 |
| 5,897,063 | A | 4/1999 | Patzelt et al. | |

FOREIGN PATENT DOCUMENTS

| | | |
|---|---|---|
| BE | 211701 | 7/1968 |
| DE | 378026 | 7/1923 |
| FR | 1478292 | 4/1967 |
| FR | 2445176 | 7/1980 |
| WO | WO00/12281 | 3/2000 |

* cited by examiner

*Primary Examiner*—Mark Rosenbaum
(74) *Attorney, Agent, or Firm*—John K. McCulloch

(57) ABSTRACT

The invention relates to a rotary tube mill and to a method of comminuting lumpy mill feed material, in which at least a first and a second grinding chamber as well as a co-rotating partition disposed between the grinding chambers are used. The material ground in the first grinding chamber is divided in the partition into first and second part-quantities of mill feed material, whereby at least a part of the second part-quantity of mill feed material proceeds into the second grinding chamber and at least the first part-quantity of the mill feed material is discharged separately from the tube mill.

20 Claims, 12 Drawing Sheets

Figure 1B:
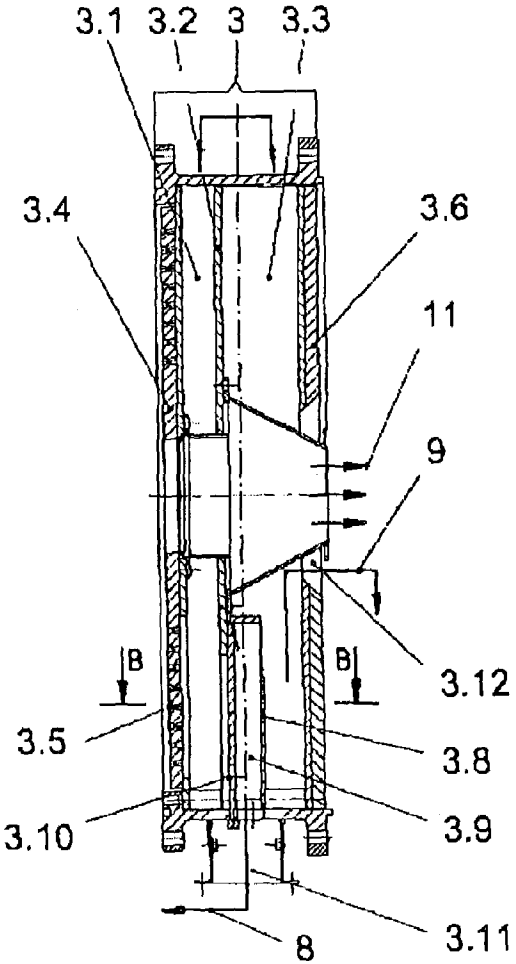

Schnitt A-A
Schnitt B-B
Schnitt C-C

TUBE GRINDER AND METHOD FOR COMMINUTING LUMPY GRINDING STOCK

The invention relates to a tube mill and to a method of comminution of lumpy mill feed material.

BACKGROUND OF THE INVENTION

Tube mills, particularly ball mills, are quite well known. They consist essentially of a first grinding chamber, at least one second grinding chamber and a co-rotating partition disposed between the grinding chambers. They are used for the comminution of different materials in the most varied industrial sectors.

The material to be comminuted is comminuted in the grinding process by the freely moving mass of grinding media, and not only spherical elements but also elements in the shape of bars or bar sections are used as grinding media.

The use of separate grinding chambers makes possible the effective use of grinding media of differing geometric construction, particularly the use of different diameters in the case of spherical grinding media. The individual grinding chambers can also have different grinding media filling ratios.

The partitions in the tube mills serve the purpose of separating the grinding media charges in adjacent grinding chambers separate from one another and of transporting the mill feed material from one grinding chamber to the other. For this purpose it is usual to dispose in the partition a discharge arrangement through which the mill feed material which has entered the intermediate chamber via inlet openings is discharged via a discharge opening into the second grinding chamber.

In order to increase the efficiency of the tube mill, it is already known that mill feed material entering the partition from the first grinding chamber is divided into oversize material and fines, whereby the fines enter the second grinding chamber via a discharge opening and the oversize material is returned to the first grinding chamber via a discharge cone directly behind the partition.

In DE 378 026 a tube mill with a central discharge is proposed, in which not only the mill feed material from the first grinding chamber but also the mill feed material from the second grinding chamber passes into the partition and from there is jointly discharged and delivered to a classifying arrangement. The returned oversize material from the classifier is in turn divided into oversize material and fines and passed on to the first or second grinding chamber respectively.

In WO 00/12281 two separate grinding mills are proposed, each with a separate grinding chamber, each having a different internal diameter. The mill feed material of the first tube mill is delivered to a separate classifier, the oversize material being returned to the first tube mill and the fines being delivered to the second tube mill.

The object of the invention is to improve the efficiency of a tube mill as well as a method of comminution of lumpy mill feed material.

SUMMARY OF THE INVENTION

The tube mill according to the invention consist essentially of a. a first or primary rotary grinding chamber, b. at least one second or secondary rotary grinding chamber, c. a co-rotating partition disposed between the grinding chambers, d. separating apparatused disposed in the partition to divide the mill feed material discharged from the first grinding chamber into a first part-quantity of mill feed material and a second part-quantity mill feed material, e. means for direct or indirect delivery of at least a part of the second part-quantity of mill feed material to the second grinding chamber, and f. an apparatus for separate discharge of the first part-quantity of mill feed material from the tube mill. In the method according to the invention for the comminution of lumpy mill feed material with a tube mill, containing at least a first and a second grinding chamber as well as a co-rotating partition disposed between the grinding chambers, the mill feed material comminuted in the first grinding chamber is divided in a partition into a first and a second part-quantity of mill feed material, wherein at least a part of the second part-quantity of mill feed material passes directly or indirectly into the second grinding chamber and at least the first part-quantity of mill feed material is discharged separately from the tube mill.

According to a preferred embodiment the separating apparatus is formed by a classifier, so that the first part-quantity of mill feed material consists of relatively coarse or oversize material and the second part-quantity of mill feed material consists of relatively smaller size fines. The classifier may be formed for example by a screen wall or slotted wall, a drum screen or screen cascaders. The discharged first part-quantity of mill feed material can be delivered totally or partially to the material feed of the first grinding chamber or to a primary grinding unit.

THE DRAWINGS

Figure 1A:
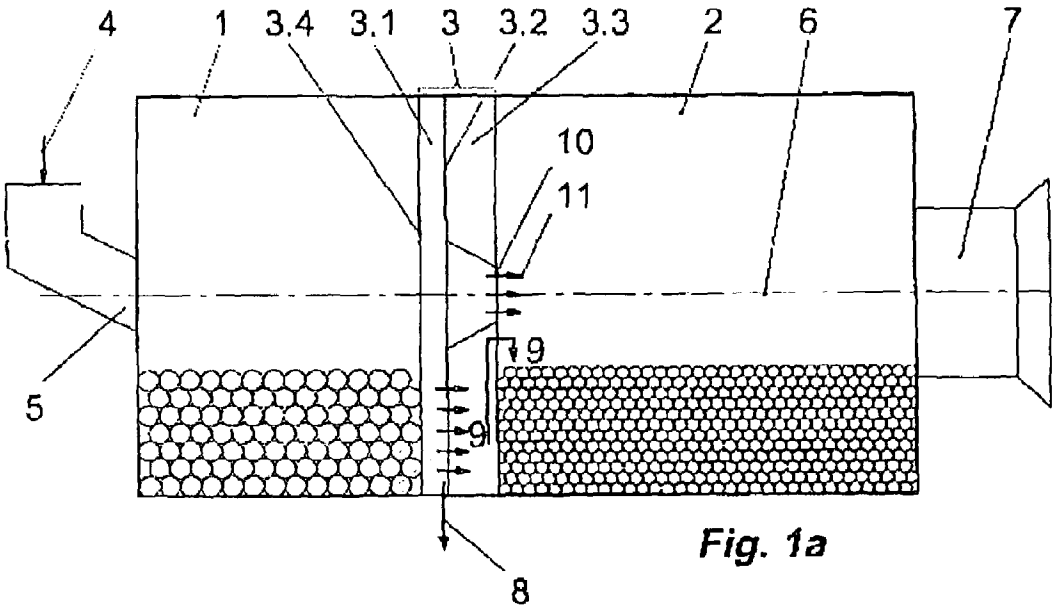
Figure 1C:
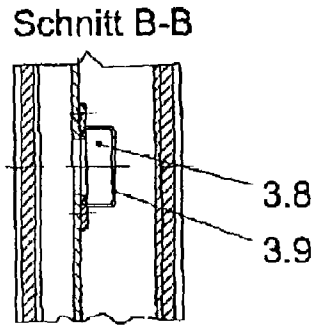
Figures 2A, 2B, 2C, 2D, 2E:
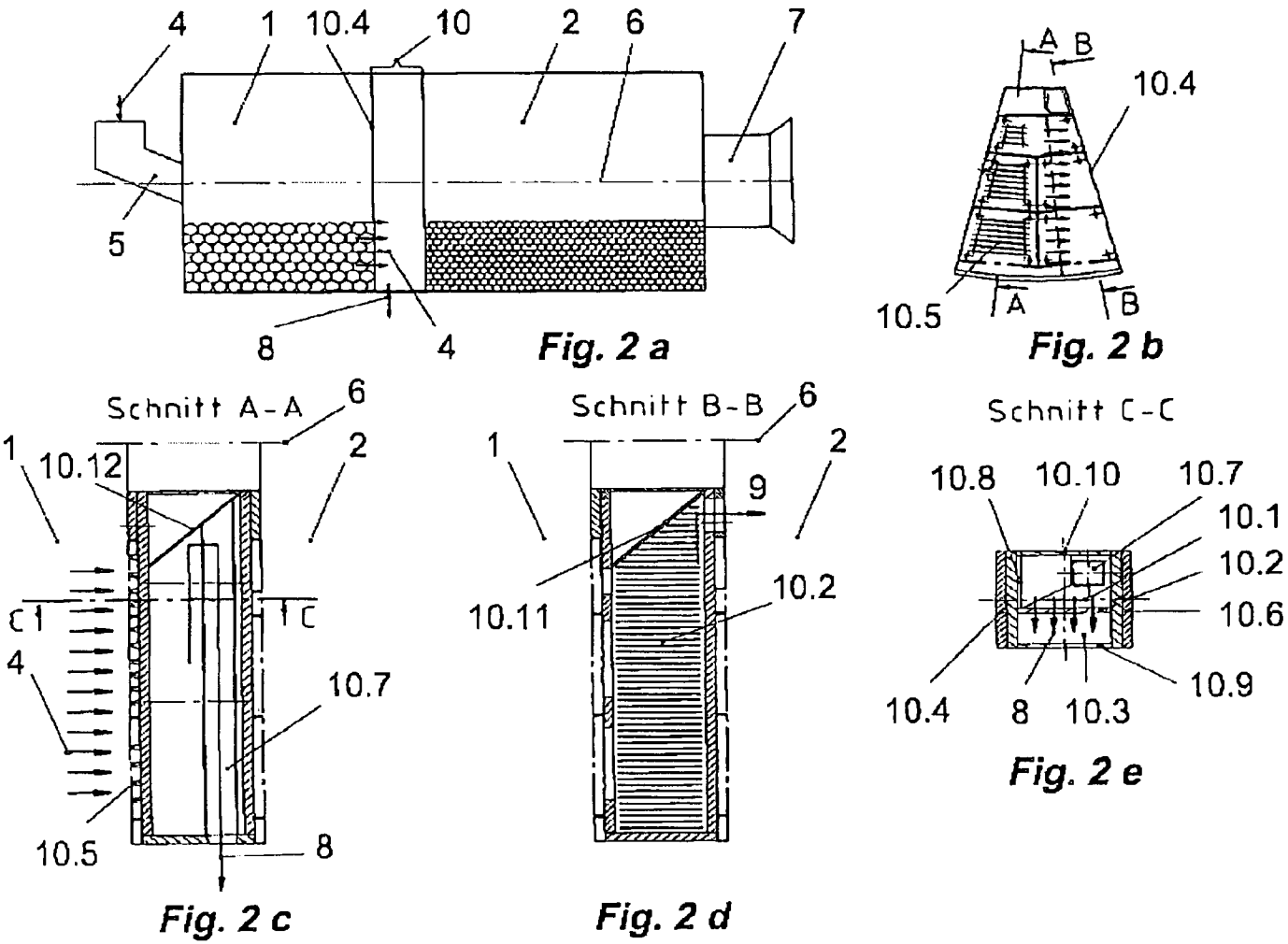
Figure 3B:
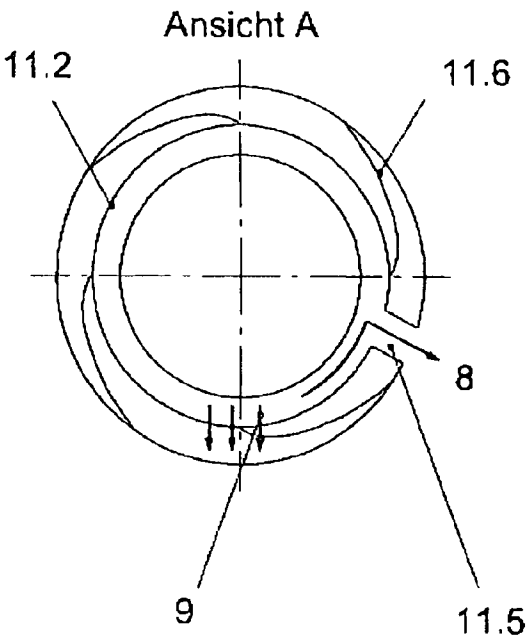
Figure 3A:
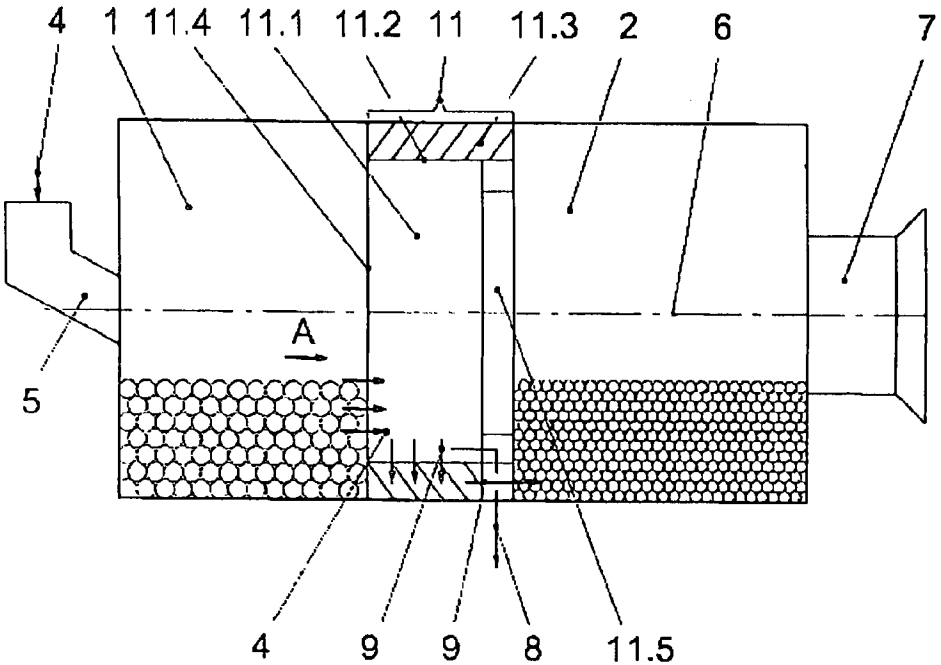
Figure 4:
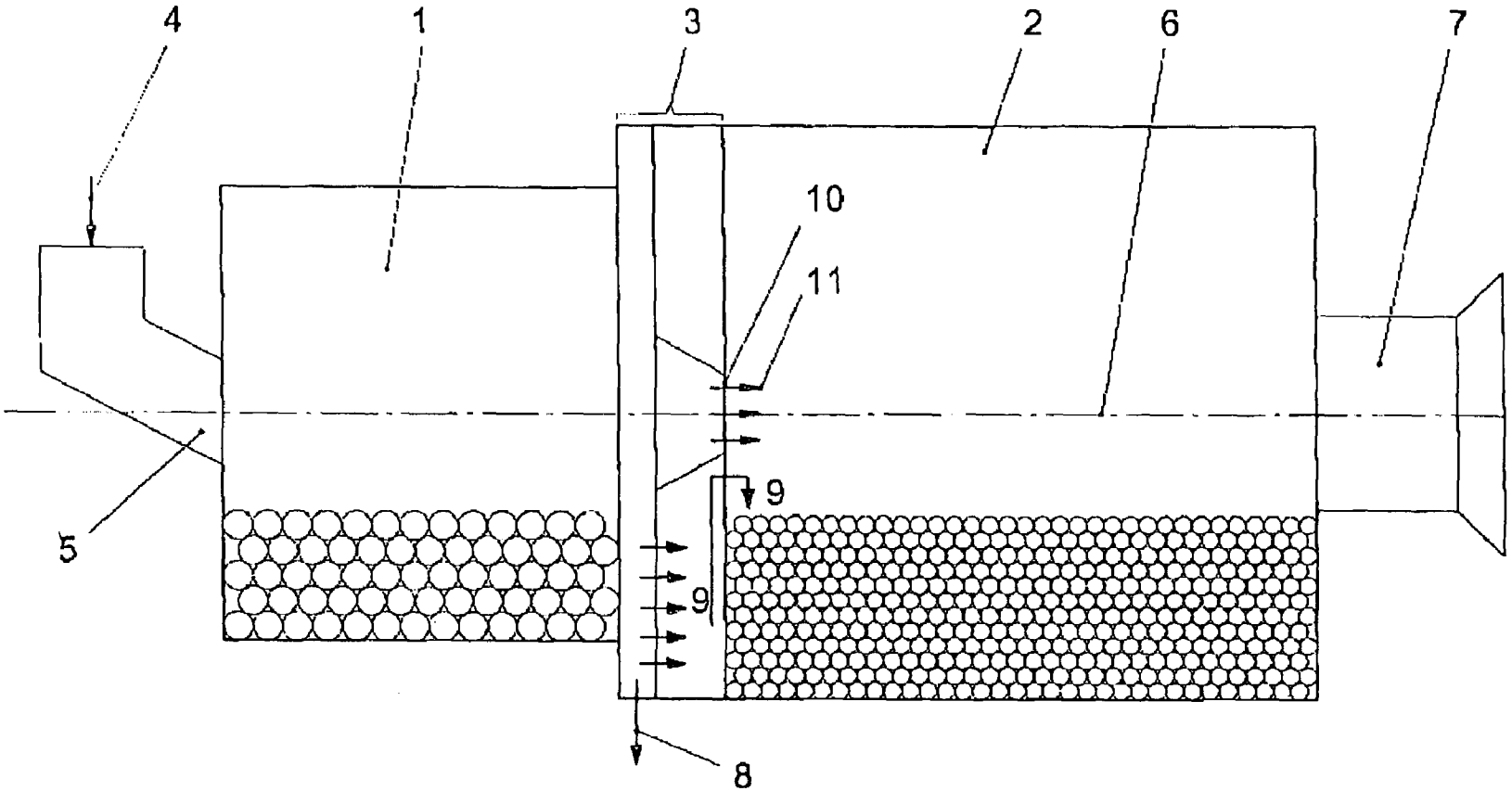
Figure 5B:
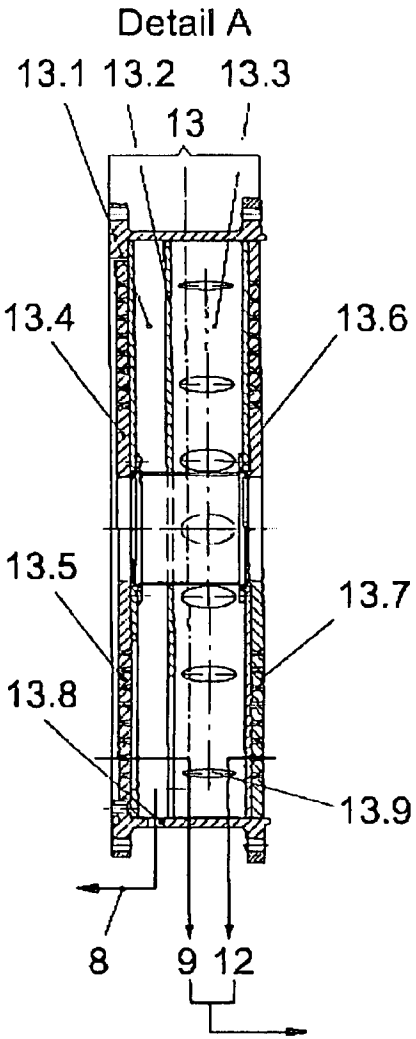
Figure 5A:
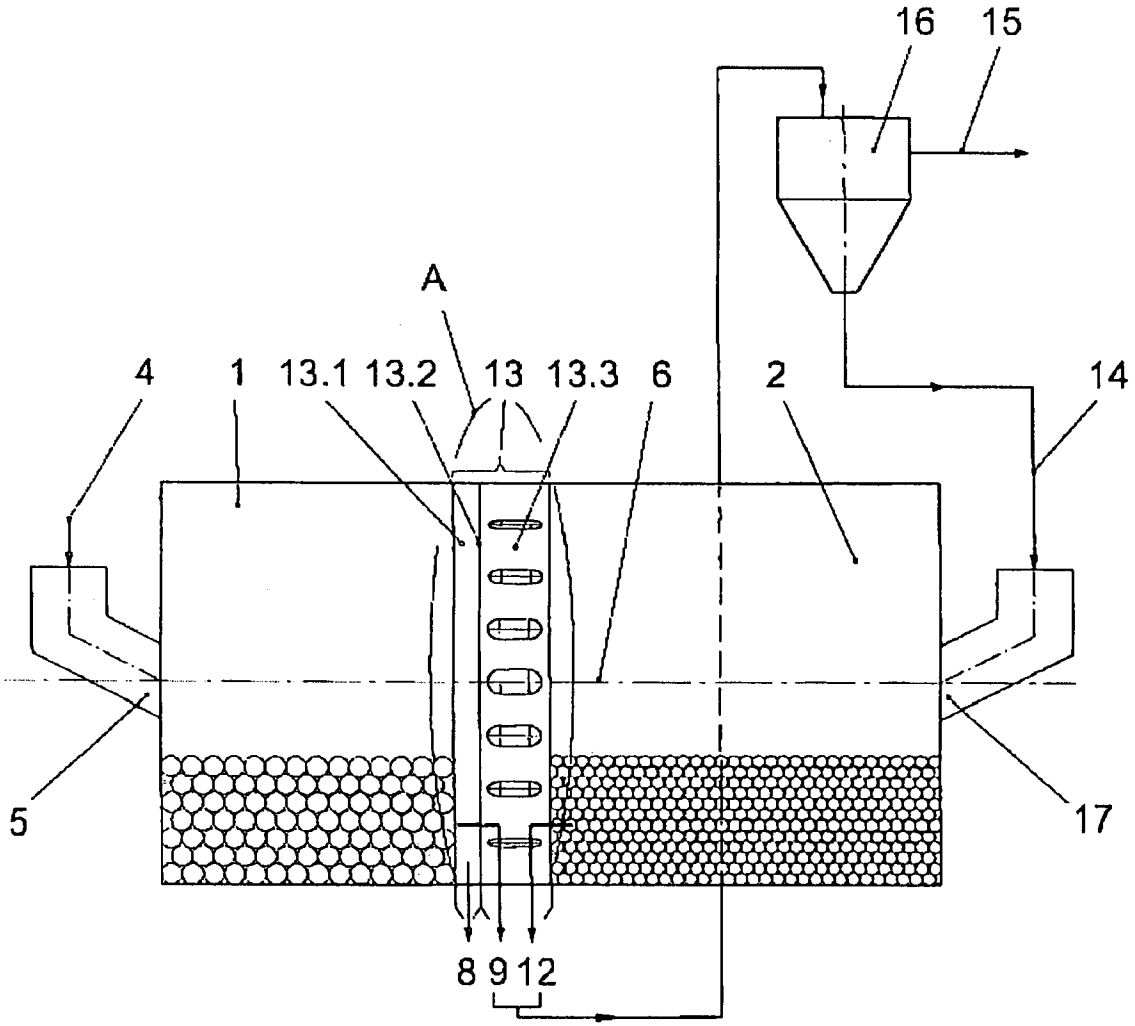

Further advantages and several embodiments of the invention are explained in greater detail below with reference to the description of some embodiments and the drawings wherein:

FIGS. 1*a* to 1*c* show schematic representations of a tube mill according to a first embodiment, FIGS. 2*a* to 2*e* show schematic representations of a tube mill according to a second embodiment, FIGS. 3*a* to 3*b* show schematic representations of a tube mill according to a third embodiment, FIG. 4 shows a schematic representation of a tube mill according to a fourth embodiment, FIGS. 5*a* to 5*b* show schematic representations of a tube mill according to a fifth embodiment, FIGS. 6 to 12 show schematic representations of grinding installations with different variants of a tube mill according to the invention.

THE PREFERRED EMBODIMENTS

The tube mill shown in FIGS. 1*a* to 1*c* consists essentially of a rotary drum having a first grinding chamber 1, a second grinding chamber 2 and a co-rotating partition 3 disposed between the grinding chambers. The mill feed material 4 passes via a material feed 5 into the first grinding chamber 1 in which it is comminuted by rotation of the tube mill about a longitudinal central axis 6. Both grinding chambers usually contain so-called grinding media which are adapted in shape, size, quantity and material to the particular requirements.

The first grinding chamber is usually separated from the partition 3 by a slotted wall 3.4 which has openings 3.5 through which the mill feed material sufficiently comminuted in the first grinding chamber passes into a first partition zone 3.1. The partition has in addition to the first partition zone 3.1 a second or downstream partition zone 3.3, these two partition zones being separated from one another by a classifier 3.2. The integrated classifier 3.2 divides the mill feed material from the first grinding chamber into a first part-quantity of mill feed material comprising oversize material 8 and a second part-quantity of oversize material comprising fines 9. The fines then pass into the second partition zone 3.3 where they are delivered via suitable means, for example known lifting elements, to the second grinding chamber 2. The oversize material 8 accumulating inside the classifier 3.2 is discharged from the tube mill and can be returned to the grinding process at a suitable point (preferably at the mill feed material inlet 4).

The construction and operation of the partition 3 will be explained in greater detail below with reference to FIGS. 1*b* and 1*c*.

In the illustrated embodiment the classifier 3.2 is constructed as a screen wall or slotted wall. In this case the first partition zone 3.1 is delimited by the slotted wall 3.4 as well as the classifier 3.2 and the second partition zone 3.3 is delimited by the classifier 3.2 and an end wall 3.6 separating the partition 3 from the second grinding chamber 2. The fines 9 coming from the first grinding chamber 1 via the openings 3.5 into the first partition zone 3.1 proceed unhindered via the classifier 3.2 into the second partition zone 3.3 where they are discharged into the second grinding chamber 2 via a conventional discharge apparatus, such as cascaders (not shown).

The oversize material 8 introduced into the first partition zone 3.1 from the first grinding chamber 1 remains in from or upstream of the classifier 3.2, so that the level of the oversize material in the first partition zone rises gradually until it has reached a certain level at which the oversize material 8 passes via an appropriate discharge opening 3.10 into a discharge passage 3.8 disposed within the classifier 3.2 The oversize material 8 is discharged from the tube mill through a discharge housing 3.11 by way of an outlet channel 3.9.

Depending upon the requirements of the process, the height of the level of the oversize material 8 in front of the classifier 3.2 can be adjusted by variation of the radial distance of the discharge opening 3.10 from the longitudinal central axis 6. The quantity of oversize material 8 which is discharged can be adjusted by variation of the size of the discharge opening 3.10.

A rotary tube mill with a co-rotating partition 10 according to a second embodiment is shown in FIGS. 2*a* to 2*e*.

The partition 10 is divided into at least one, but preferably several screen chambers which are disposed as segments circumferentially of the longitudinal central axis 6. Each screen chamber is delimited by radial side walls 10.9, 10.10 as well as a part of the slotted wall 10.4 facing the first grinding chamber 1 as well as a part of the end wall 10.6 facing the second grinding chamber 2. FIG. 2*b* shows a portion of the slotted wall 10.4 belonging to a partition chamber. Each partition chamber is divided by a screen cascader 10.2 into a first partition chamber 10.1 and a second partition chamber 10.3. The inlet openings 10.5 of the slotted wall 10.4 are provided only in the region of the first partition chamber 10.1, 50 that the mill feed material ground in the grinding chamber 1 enters the first partition chamber 10.1 through the inlet openings 10.5. Due to the rotation of the tube mill the mill feed material located in the first partition chamber 10.1 is raised via the screen cascaders 10.2. The fines 9 contained in the mill feed material pass through the screen openings of the screen cascaders 10.2 into the second partition zone 10.3 where they are led via a fines deflector 10.1 1 into the second grinding chamber. The oversize material 8, on the other hand, runs over the screen cascaders 10.2 and is then conveyed over an oversize material deflector 10.12. into a shaft 10.7. The oversize material 8 located in the shaft 10.7 is discharged from the tube mill by the rotation of the mill.

The variant illustrated in FIGS. 3*a* and 3*b* shows a partition 11 in which the separating or classifying arrangement is formed by a screen drum 11.2 which divides the partition into an inner first partition zone 11.1 and an outer second partition zone 11.3.

The mill feed material passes via inlet openings in the slotted wall 11.4 into the first partition zone of the screen drum 11.2. On the way to the oversize material discharge channel 11.5 which is disposed at the end of the screen drum, the fines 9 fall through the screen drum into the second partition zone 11.3. The fines are conveyed into the second grinding chamber 2 via conveying plates 11.6 which are preferably constructed as worm plates. The oversize material 8 is collected in the oversize material discharge channel 11.5 and discharged from the tube mill via an oversize material discharge shaft.

The embodiment according to FIG. 4 shows a tube mill with a first grinding chamber 1, a second grinding chamber 2 and a co-rotating partition 3 disposed between the two grinding chambers. In the partition is disposed a classifier which can be constructed for example according to one of the variants shown in FIGS. 1 to 3.

The internal diameter of the first grinding chamber 1 is smaller than the internal diameter of the grinding chamber 2 which follows it in the material flow direction. Such a progressive ratio allows an optimised geometry to be produced which takes into account the grinding media filling ratio, the grinding media dimensions, the type of mill feed material, etc.

Whereas in all the previously shown variants the fines pass directly into the second grinding chamber via an end wall separating the partition from the second mill feed material chamber, in the embodiment according to FIGS. 5*a* and 5*b* a so-called central discharge is provided. In such a tube mill not only the mill feed material from the first grinding chamber 1 but also the mill feed material from the second grinding chamber 2 passes into a co-rotating partition 13 disposed between the two grinding chambers. The partition 13 again contains a classifier 13.2 which may be constructed for example according to one of the variants set out above. In the illustrated embodiment it is formed by a screen wall. The classifier 13.2 again divides the partition into a first partition zone 13.1 and a second partition zone 13.3.

The partition 13 is delimited relative to the grinding chamber 1 by a slotted wall 13.4 and relative to the second grinding chamber 2 by a slotted wall 13.6. The mill feed material from the first grinding chamber 1 enters the first partition zone 13.1 via inlet openings 13.5. The mill feed material from the second grinding chamber 2 passes via inlet openings 13.7 into the second partition zone. The classifier 13.2 constructed as a screen wall allows the fines from the first partition zone 13.1 to pass through into the second partition zone 13.3.

The oversize material 8 from the first partition zone 13.1 is discharged separately via first discharge means 13.8. The fines 9 and the mill feed material 12 from the second grinding chamber 2 are discharged from the tube mill via second discharge means 13.9. According to FIG. 5*a* the material discharged from the second partition zone 13.3 is preferably fed to a classifier 16. There the material is divided into finished material 15 and tailings 14, and the tailings are returned to the grinding process preferably via a material feed 17 to the second grinding chamber 2.

Various grinding installations will be described below which each have a tube mill essentially comprising a first grinding chamber 1, a second grinding chamber 2 and a co-rotating partition 30 disposed between the grinding chambers. A separating arrangement 32 for dividing the mill feed material from the first grinding chamber 1 into a first part-quantity of mill feed material 8 and a second part-quantity of mill feed material 9 is provided in the partition. Although the separating arrangement is preferably constructed as a classifier, it is also possible for a simple division in terms of quantity to be carried out in this zone. In this way two or three material streams can be led out of the tube mill separately, resulting in advantages for the routing of the material according to the process. Thus in particular the residence time in the two grinding chambers can be influenced and controlled and can optionally be used for optimising the power requirement.

The tube mills shown in FIGS. 6 to 12 can be designed in particular according to one of the embodiments described in connection with FIGS. 1 to 5.

Figure 6:
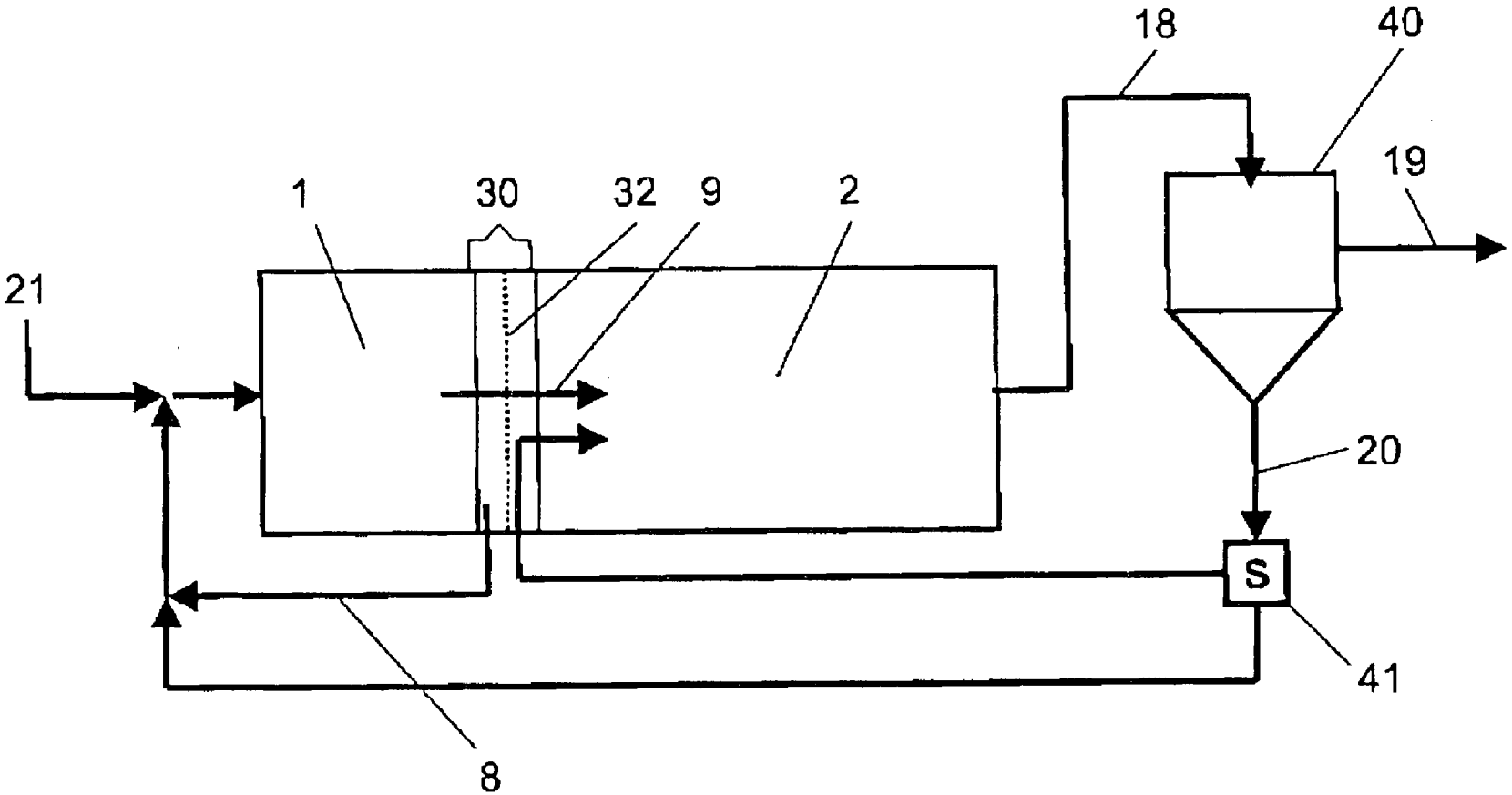

In FIG. 6 a tube mill is operated in closed grinding circuit with a classifying device 40. The mill feed material from the first grinding chamber 1 passes into the partition 30 where it is divided into a first part-quantity of mill feed material 8 and a second part-quantity of mill feed material 9. Whereas the first part-quantity of mill feed material 8 is discharged from the tube mill, the second part-quantity of mill feed material 9 passes into the second grinding chamber 2. The material 18 discharged from the second grinding chamber 2 is fed to a classifying device 40 which may be formed by a static or dynamic separator or classifier. The fines from the classifying device are drawn off as finished material 19, whilst the oversize material 20 is transported via a material divider 41 partially or totally into the second grinding chamber 2 or into the first grinding chamber 1. In addition to any oversize material 20 returned from the classifying device, the first part-quantity of mill feed material 8 as well as fresh material 21 are fed to the first grinding chamber 1.

Figure 7:
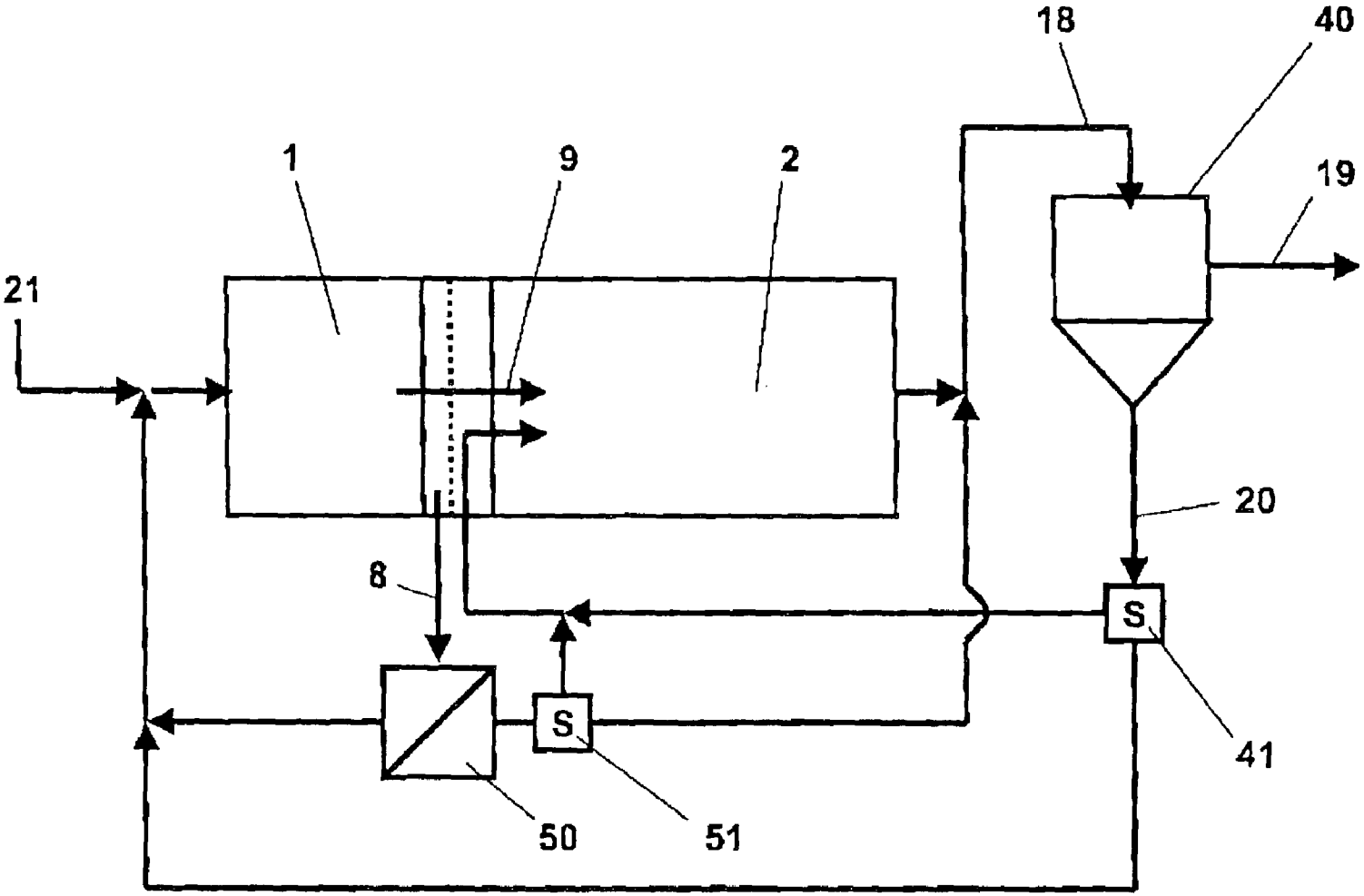

The grinding installation shown in FIG. 7 differs from the preceding embodiment in that the first part-quantity of mill feed material 8 discharged from the partition is delivered to a classifying device 50. Thus the first part-quantity of mill feed material 8 is classified outside the tube mill, the oversize material fraction being returned to the first grinding chamber 1. The fines from the classifying device 50 can be delivered via a material divider 51 completely or partially to the second grinding chamber 2 or to the classifying device 40.

Figure 8:
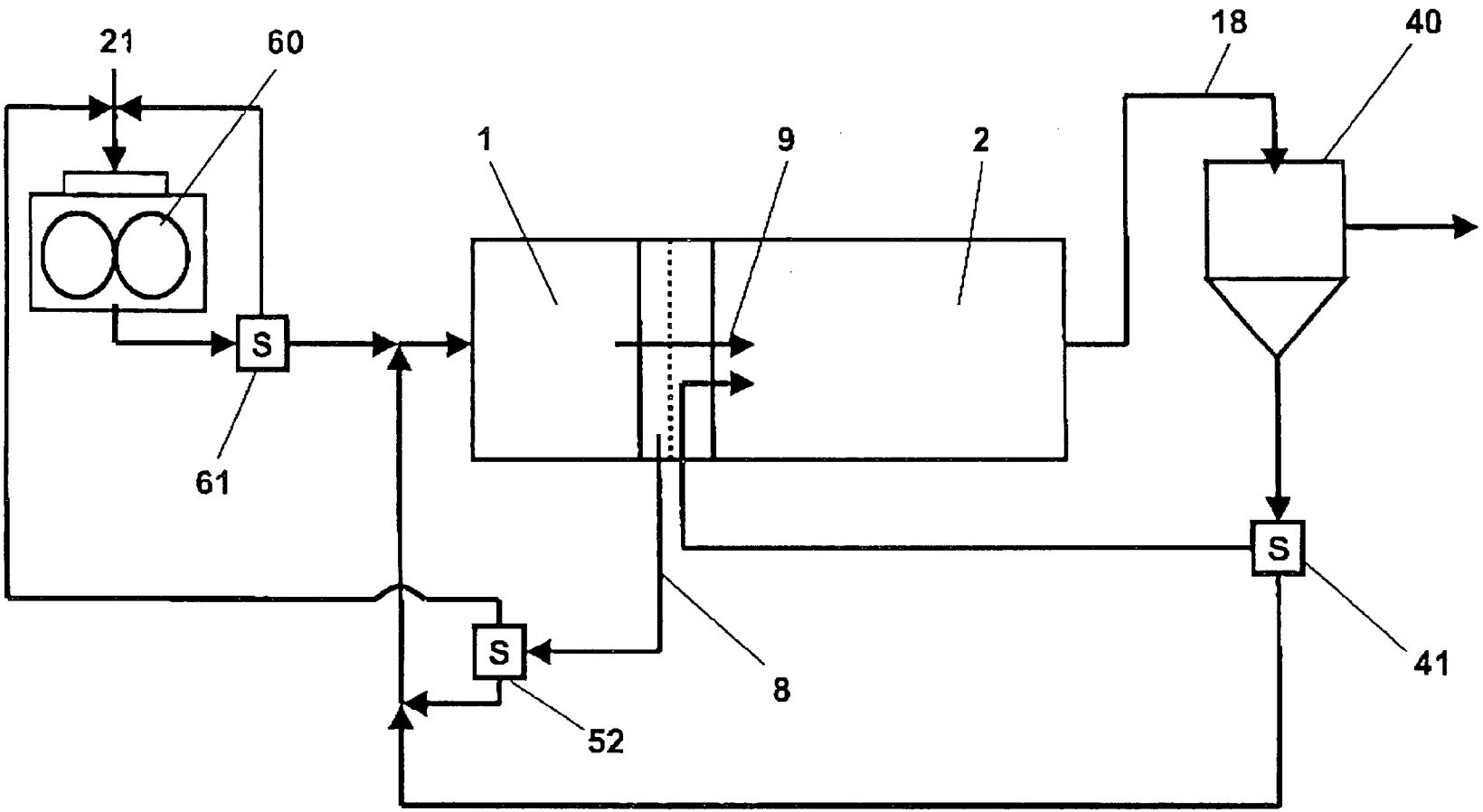

In FIG. 8 the tube mill is operated in closed grinding circuit with a classifying device 40 and a primary comminution stage. In contrast to the grinding installation according to FIG. 6, the fresh material 21 is delivered to the grinding unit 60 where the mill feed material is pre-comminuted. All or part of the pre-comminuted material is then fed to the first grinding chamber 1. By way of a material divider 61 it is possible to recirculate a part of the pre-comminuted material back to the grinding unit 60.

The first part-quantity of mill feed material discharged from the tube mill can be delivered via a splitter 52 completely or only partially to the first grinding chamber 1 or to the grinding unit 60.

Figure 9:
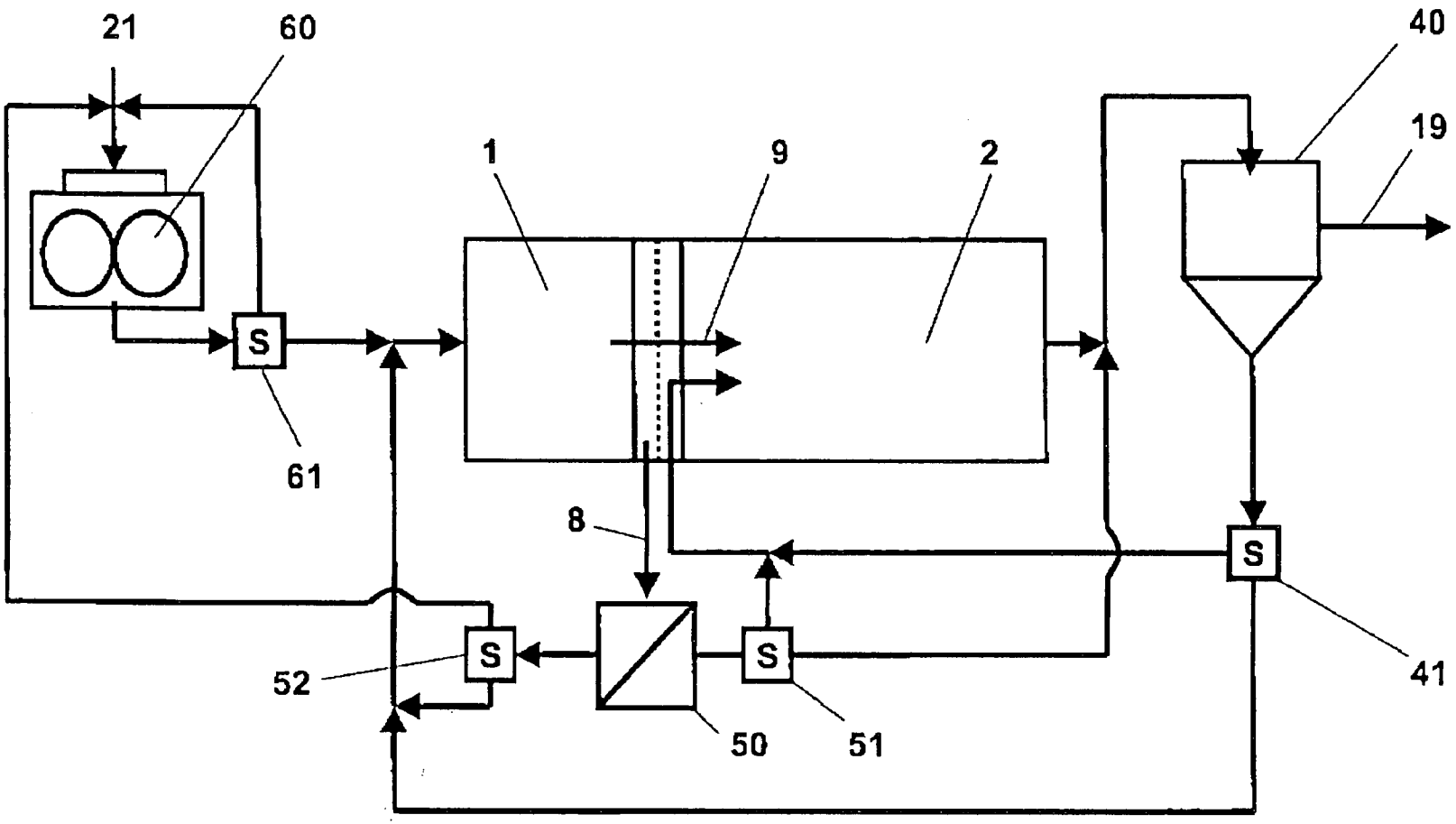

FIG. 9 shows the variant according to FIG. 7 in conjunction with a grinding unit 60 according to FIG. 8. In this case the oversize material from the classifying device 50 can be fed completely or partially to the first grinding chamber 1 or to the grinding unit 60.

Figure 10:
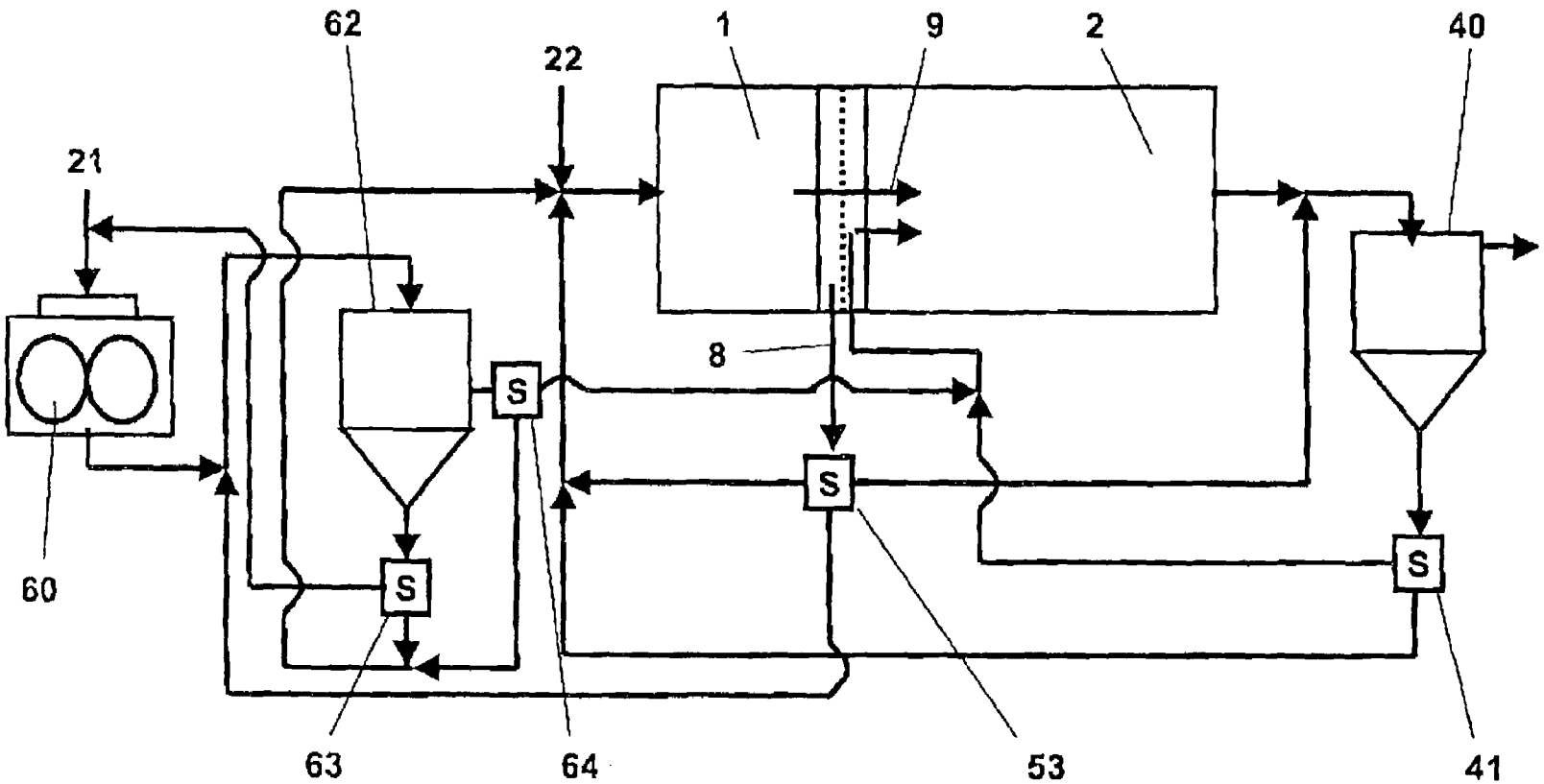

The grinding installation according to FIG. 10 provides a primary comminution stage with a grinding unit 60 in conjunction with a classifying device 62. The classifying device may be constructed as a static or dynamic separator.

The first part-quantity of mill feed material 8 discharged from the tube mill can be delivered via a material divider 53 partially or completely to the first grinding chamber 1, the classifying device 62 or the classifying device 40. The fines from the classifying device 62 are delivered via a material divider 64 either completely partially to the second grinding chamber 2 or to the first grinding chamber 1. The oversize material from the classifying device 62 passes via a material divider 63 either completely or partially into the first grinding chamber 1 and/or to the grinding unit 60, which is operated on the one hand with fresh material and on the other hand with oversize material from the classifying device 62. The oversize material from the grinding unit 60 then passes into the classifying device 62. It is also possible to feed fresh material 22 directly to the first grinding chamber, bypassing the primary comminution.

Figure 11:
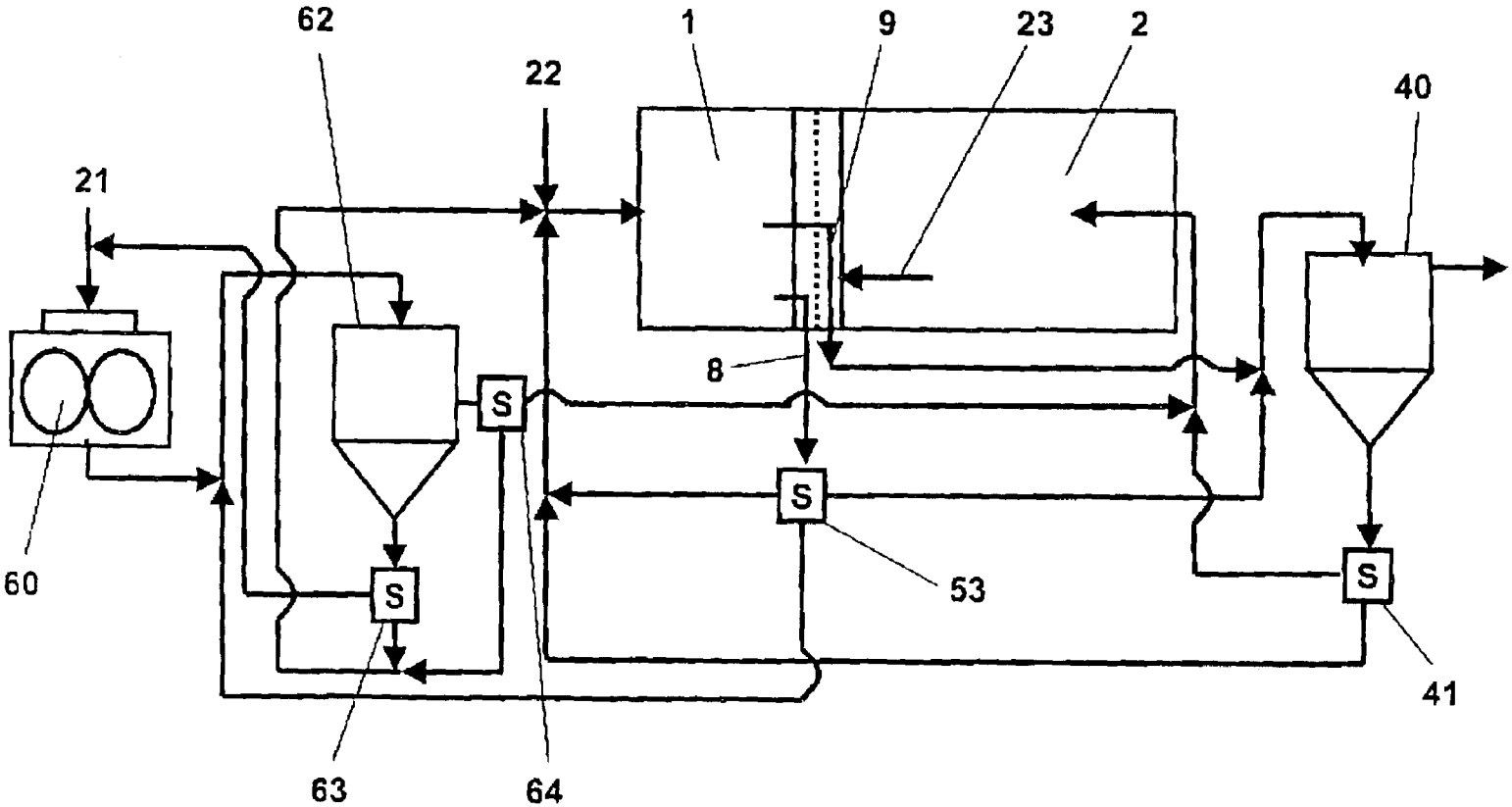
Figure 12:
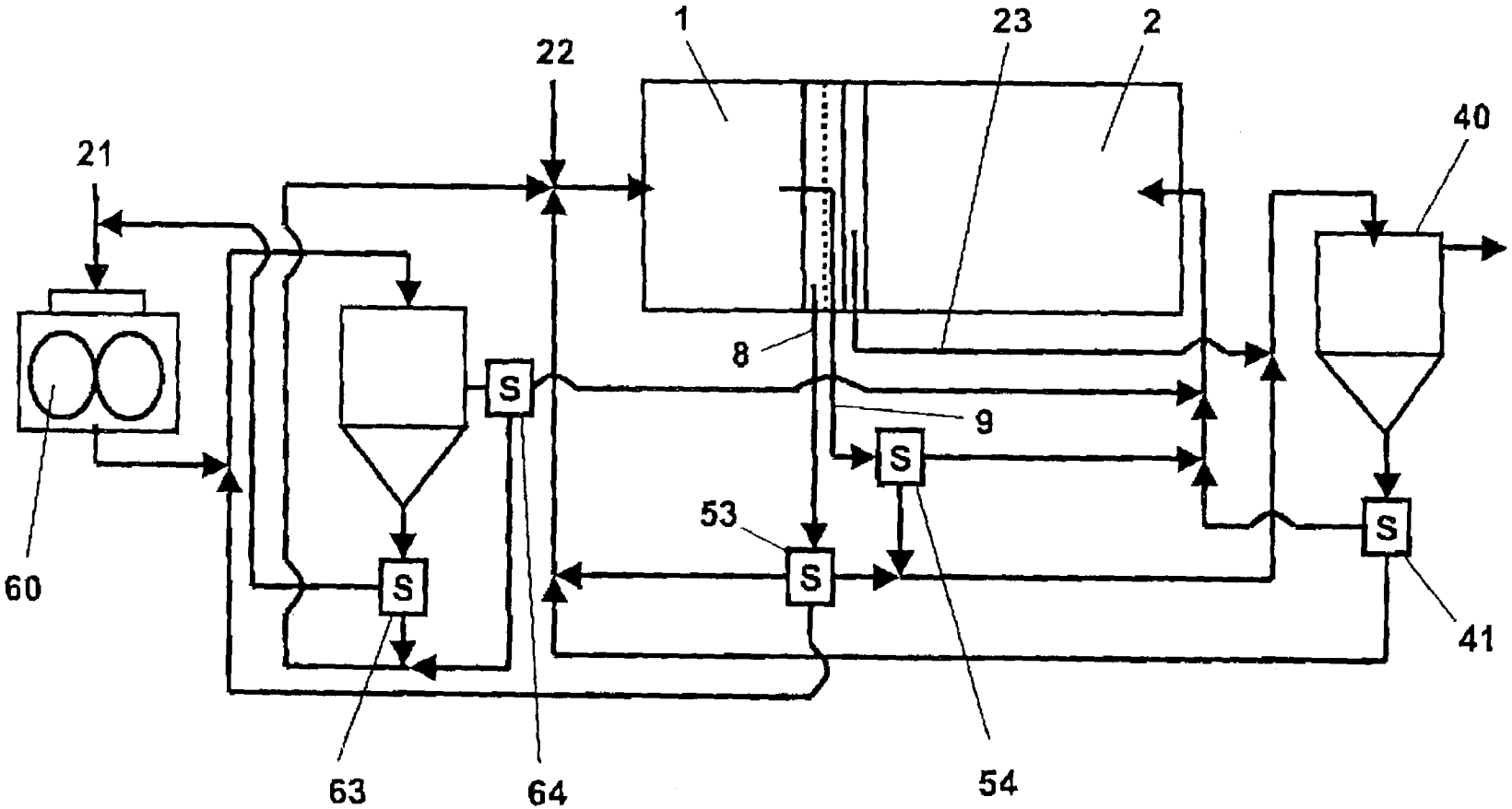

The grinding installations according to FIGS. 11 and 12 use tube mills with a central discharge. In the embodiment according to FIG. 11 the first part-quantity of mill feed material is again discharged separately. The second part-quantity of mill feed material 9 is discharged together with the mill feed material entering the partition from the second grinding chamber 2, and is fed to the classifying device 40. The oversize material from the classifying device 40 is fed via a material divider 41 partially or completely to the second grinding chamber 2. Another portion can be returned to the first grinding chamber 1. The first part-quantity of mill feed material 8 is delivered via a material divider 53 partially or completely to the first grinding chamber 1, the classifying device 40 or the classifying device 62.

The variant according to FIG. 12 differs from the grinding installation according to FIG. 11 in that the second part-quantity of mill feed material 9 and the mill feed material 23 entering the partition from the second grinding chamber 2 are discharged separately from one another, so that three material streams, namely the first part-quantity of mill feed material 8, the second part-quantity of mill feed material 9 and the mill feed material 23 are discharged from the tube mill. The first part-quantity of mill feed material 8 is delivered as previously to a material divider 53. The mill feed material 23 from the second grinding chamber passes directly into the classifying device 40, whilst the second part-quantity of mill feed material 9 is fed via a material divider 54 partially or completely to the second grinding chamber 2 and/or to the classifying device 40.

The variants of grinding installations set out above should merely be understood as examples. However, they show that the discharged first part-quantity of mill feed material can be delivered in many different ways to parts of the installation which are connected upstream or downstream. This makes improved grinding efficiency and advantages in the routing of material possible, so that the specific power requirement can be reduced.

We claim:

1. In a tube mill for grinding mill feed material, said mill having:

a. a first rotary grinding chamber, b. at least one second rotary grinding chamber downstream of the first grinding chamber, c. a co-rotary partition disposed between the grinding chambers, d. separating means carried by the partition to divide mill feed material from the first grinding chamber into a first part-quantity of relatively coarse mill feed material and a second part-quantity of relatively fine mill feed material, and e. delivery means for delivering via said partition at least a part of the second part-quantity of mill feed material to the second grinding chamber, the improvement comprising:

f. discharge means separate from said delivery means for discharging independently of said second part-quantity of mill feed material the first part-quantity of mill feed material from the tube mill.

2. The construction according to claim 1 including means for returning the discharged first part-quantity of mill feed material to the first grinding chamber.

3. The construction according to claim 1 wherein the delivery means for delivering the second part-quantity of mill feed material to the second grinding chamber is so positioned that the second part-quantity of mill feed material passes into the second grinding chamber via an end wall separating the partition from the second grinding chamber.

4. The construction according to claim 1 wherein the partition has a first zone and a second zone, the two zones being separated from one another by the separating means, and wherein the means for discharging the first part-quantity of mill feed material from the tube mill communicates with the first zone and wherein the means for delivering the second part-quantity of mill feed material to the second grinding chamber communicates with the second zone.

5. The construction according to claim 1 wherein the first grinding chamber has a diameter smaller than that of the second grinding chamber.

6. The construction according to claim 1 wherein the separating means is formed by a wall having openings therein.

7. The construction according to claim 1 wherein the separating means is formed by a screen drum.

8. The construction according to claim 1 wherein the separating means is formed by cascaders carried by the partition.

9. The construction according to claim 1 including means for discharging the mill feed material from the second grinding chamber into the partition, and means for discharging from the mill the material from the second grinding chamber and the second part-quantity of mill feed material.

10. The construction according to claim 1 including inlet means for said mill feed material at an end of said first grinding chamber remote from said partition, and means for returning to said first grinding chamber via said inlet means at least a portion of the first part-quantity discharged from said tube mill.

11. A method of comminuting mill feed material in a rotary tube mill having first and second grinding chambers separated by a co-rotary partition, said method comprising rotating said mill; delivering material to be comminuted to said first grinding chamber during rotation of said mill; grinding said material in said first chamber to form respective relatively coarse and relatively fine first and second part-quantities of ground material; delivering at least a portion of said second part-quantity of said ground material from said first grinding chamber to said second grinding chamber; and discharging independently of said second part-quantity of said ground material at least the first part-quantity of said ground material from said mill.

12. The method according to claim 11 including returning at least part of first part-quantity of ground material to the first grinding chamber.

13. The method according to claim 11 including returning a part of the first part-quantity of ground material to the first grinding chamber and the remainder of said first part-quantity of ground material to a classifier outside said mill.

14. The method according to claim 11 including delivering the first part-quantity of ground material to a classifier outside the mill.

15. The method according to claim 11 including delivering ground mill material from the second grinding chamber to a classifier outside the tube mill and delivering oversize material from said classifier to a selected one of said grinding chambers.

16. The method according to claim 11 including pre-comminuting said feed mill material in a primary comminuting stage upstream of said mill.

17. The method according to claim 16 including delivering a part of the first part-quantity of ground material discharged from said first grinding chamber to said primary comminuting stage and returning the remainder of ground material discharged from said first grinding chamber to said first grinding chamber.

18. The method according to claim 16 including classifying the pre-comminuted material downstream from said primary pre-comminuting stage into fines and relatively large particles, delivering the relatively large particles to a selected one of said first grinding chamber or said pre-comminuting stage, and delivering the fines to said second grinding chamber.

19. The method according to claim 16 including classifying the pre-comminuted material downstream from said primary pre-comminuting stage into fines and relatively large particles to a selected one of said first grinding chamber or said pre-comminuting stage, and delivering the fines to said second grinding chamber.

20. The method according to claim 1 including delivering said material to be comminuted to said first grinding chamber via an inlet remote from said partition, and returning at least a portion of said discharged first part-quantity of said ground material to said first chamber via said inlet.

* * * * *

UNITED STATES PATENT AND TRADEMARK OFFICE

CERTIFICATE OF CORRECTION

PATENT NO. : 7,073,737 B2
APPLICATION NO. : 10/497293
DATED : July 11, 2006
INVENTOR(S) : Ludger Schulte et al.

It is certified that error appears in the above-identified patent and that said Letters Patent is hereby corrected as shown below:

Column 8, line 52, change "1" to -- 11 --.

Signed and Sealed this

Fourteenth Day of November, 2006

JON W. DUDAS
*Director of the United States Patent and Trademark Office*